US008702476B2

(12) United States Patent
Ito et al.

(10) Patent No.: US 8,702,476 B2
(45) Date of Patent: Apr. 22, 2014

(54) MACHINE FOR CENTRIFUGALLY SHOOTING ABRASIVES

(75) Inventors: Masakatsu Ito, Toyokawa (JP); Kyoichi Iwata, Toyokawa (JP); Masaji Shiga, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 360 days.

(21) Appl. No.: 13/129,639

(22) PCT Filed: Dec. 9, 2009

(86) PCT No.: PCT/JP2009/070608
§ 371 (c)(1),
(2), (4) Date: May 17, 2011

(87) PCT Pub. No.: WO2010/067822
PCT Pub. Date: Jun. 17, 2010

(65) Prior Publication Data

US 2011/0229335 A1 Sep. 22, 2011

(30) Foreign Application Priority Data

Dec. 12, 2008 (JP) ..... 2008-316334
Nov. 5, 2009 (JP) ..... 2009-253725

(51) Int. Cl.
*F01D 5/14* (2006.01)

(52) U.S. Cl.
USPC ..... 451/95; 451/97; 451/98

(58) Field of Classification Search
USPC ..... 451/94, 95, 96, 97, 98
See application file for complete search history.

(56) References Cited

U.S. PATENT DOCUMENTS 3,785,105 A * 1/1974 Freeman ..... 451/97
4,751,798 A * 6/1988 McDade ..... 451/95
(Continued)

FOREIGN PATENT DOCUMENTS

JP 58181573 A * 10/1983
JP 3-36762 4/1991
(Continued)

OTHER PUBLICATIONS

International Search Report dated Mar. 9, 2010 issued in corresponding International Application No. PCT/JP2009/070608.

*Primary Examiner* — Lee D Wilson
*Assistant Examiner* — Tyrone V Hall, Jr.
(74) *Attorney, Agent, or Firm* — Finnegan, Henderson, Farabow, Garrett & Dunner, L.L.P.

(57) ABSTRACT

A machine for centrifugally shooting abrasives that shoots the abrasives by rotation of an impeller is provided. In the machine, the impeller comprises a pair of disc-shaped side plates that face each other at a predetermined distance and a plurality of blades disposed between the side plates in the radial direction of the side plates. The impeller is mounted on a hub that is fitted into an output shaft of an electric motor. The impeller is covered by a cover. The side liner and blades of the machine can be easily replaced. A side liner 3 that is U-shaped with the longer side facing downward is detachably attached to the inner side of the cover 2. The upper part of the side liner is divisible into two parts. The side liner protects the side wall of the cover 2 from the abrasives that are shot from the impeller. The side liner has a U-shaped cross section. The impeller 1 is fixed to the hub 4 by screwing a bolt 15 on the hub 4 from the inner sides of the side plates 11. The diameter of the impeller 1 is limited to be 200 mm at maximum.

2 Claims, 3 Drawing Sheets

(56) References Cited

U.S. PATENT DOCUMENTS

| | | | | |
|---|---|---|---|---|
| 5,024,028 | A * | 6/1991 | Pierce et al. | 451/95 |
| 6,835,123 | B2 * | 12/2004 | Shiga et al. | 451/94 |
| 2004/0121706 | A1 * | 6/2004 | Murosako | 451/38 |

FOREIGN PATENT DOCUMENTS

| | | | |
|---|---|---|---|
| JP | 5-29669 | | 4/1993 |
| JP | 5-369860 | | 5/1993 |
| JP | 5-60768 | | 8/1993 |
| JP | 08206959 | A * | 8/1996 |
| JP | 09150369 | A * | 6/1997 |
| JP | 10015829 | A * | 1/1998 |
| JP | 2003-251564 | | 9/2003 |
| JP | 2006218552 | A * | 8/2006 |
| JP | 2007075914 | A * | 3/2007 |
| JP | 4085353 | | 2/2008 |

* cited by examiner

MACHINE FOR CENTRIFUGALLY SHOOTING ABRASIVES

TECHNICAL FIELD

The present invention relates to a machine for centrifugally shooting abrasives. In particular, it relates to a machine for centrifugally shooting abrasives wherein an impeller comprises a pair of disc-shaped side plates that face each other with a predetermined distance between them and a plurality of blades disposed between the side plates in the radial direction of the side plates. The impeller is mounted on a hub that is fitted into an output shaft of an electric motor. The impeller is covered by a cover. Thus the abrasives are shot by the centrifugal force generated by the rotation of the impeller.

BACKGROUND ART

A typical example of conventional machines for shooting abrasives is disclosed in Japanese Patent No. 4085353. In that machine, the impeller comprises two side plates, i.e., a first side plate and a second side plate, and a plurality of blades. The impeller is mounted on the end of a rotating shaft. It is covered by a cover. The cover is protected by a liner that is divided into a plurality of pieces. The liner comprises a first-side liner component that is shaped as a trapezoidal plate. The first-side liner component is detachably secured by a screw to the side near the rotating shaft on the inner side of the cover. It has openings through which the first and second side plates pass. The liner also comprises a second-side liner component that is shaped as a trapezoidal plate. The second-side liner component is detachably secured by a screw to the side away from the rotating shaft on the inner side of the cover. It has openings through which the first and second side plates pass. The liner also comprises a front-side liner component that is U-shaped. The front-side liner component is installed between the front ends of the first- and second-side liners. The liner also comprises a rear-side liner component that is U-shaped. The second-side liner component is installed between the back ends of the first- and second-side liners. The liner also comprises a frame liner component that is shaped as an endless belt. The frame liner component is detachably placed around the upper ends of the first- and second-side liners and the front- and rear-side liners. The liner also comprises a ceiling-side liner component. The ceiling-side liner component has a looped projection formed on its lower surface. The looped projection is detachably inserted into the upper end of the frame liner component to cover the opening formed by the upper ends of the first- and second-side liners and the front- and rear-side liners. By configuring the liner as discussed above, the replacement of the liner components, which protect the cover for the impeller, becomes easier.

DISCLOSURE OF INVENTION

However, the conventional machine for centrifugally shooting abrasives that has the above configuration still requires much work to replace the side liners. Further, since the impeller is big and heavy, the work to replace the blades is troublesome.

The present invention has been conceived in view of such a situation. The object of the invention is to provide a machine for centrifugally shooting abrasives for which the side liners and blades can be easily replaced.

To achieve the above object, the machine for centrifugally shooting abrasives of the present invention is configured as follows. The impeller comprises a pair of disc-shaped side plates that face each other with a predetermined distance between them and a plurality of blades disposed between the side plates in the radial direction of the side plates. The impeller is mounted on a hub that is fitted into an output shaft of an electric motor. The impeller is covered by a cover. Thus the abrasives are centrifugally shot by the centrifugal force generated by the rotation of the impeller. In the machine, a side liner that is generally U-shaped, with the longer side facing downward, is detachably attached to the inner side of the cover. The upper part of the side liner is divisible into two parts. The side liner is to protect the side wall of the cover from the abrasives that are shot from the impeller. The impeller is fixed to the hub by screwing a bolt on the hub from the inner side of the side plate. The diameter of the impeller is limited to be 200 mm at maximum.

The basic Japanese patent applications, No. 2008-316334, filed Dec. 12, 2008, and No. 2009-253725, filed Nov. 5, 2009, are hereby incorporated by reference in their entirety in the present application.

The present invention will become more fully understood from the detailed description given below. However, the detailed description and the specific embodiment are only illustrations of desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

As discussed above, since the machine for centrifugally shooting abrasives of the present invention is configured as follows, it has advantageous effects, such as enabling the easier replacement of the side liner or blades. The impeller comprises a pair of disc-shaped side plates that face each other with a predetermined distance between them and a plurality of blades disposed between the side plates in the radial direction of the side plates. The impeller is mounted on a hub that is fitted into an output shaft of an electric motor. The impeller is covered by a cover. Thus the abrasives are centrifugally shot by the centrifugal force generated by the rotation of the impeller. In the machine, a side liner that is generally U-shaped, with the longer side facing downward, is detachably attached to the inner side of the cover. The upper part of the side liner is divisible into two parts. The side liner is to protect the side wall of the cover from the abrasives that are shot from the impeller. The impeller is fixed to the hub by screwing a bolt on the hub from the inner side of the side plate. The diameter of the impeller is limited to be 200 mm at maximum.

BEST MODE FOR CARRYING OUT THE INVENTION

Figure 1:
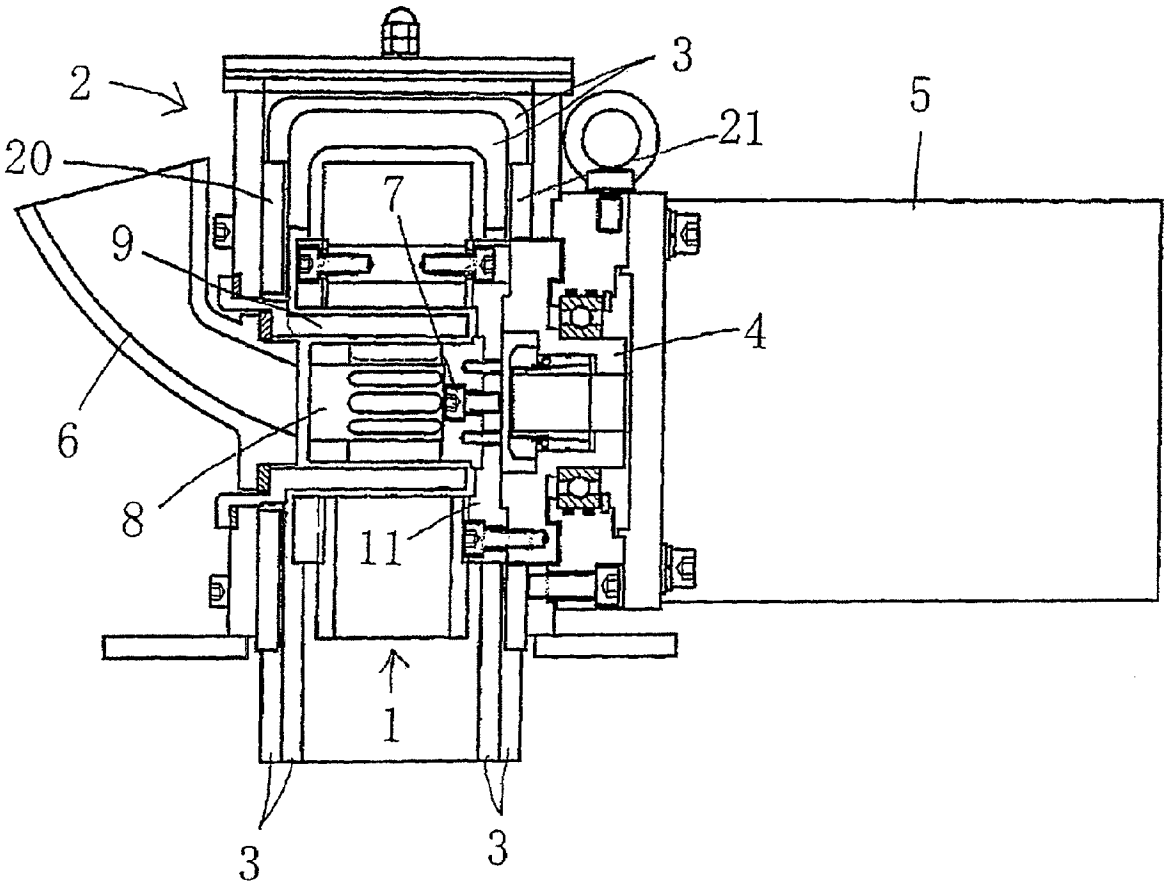
FIG. 1 is a side view with a partial sectional view showing the embodiment of the present invention.
Figure 2:
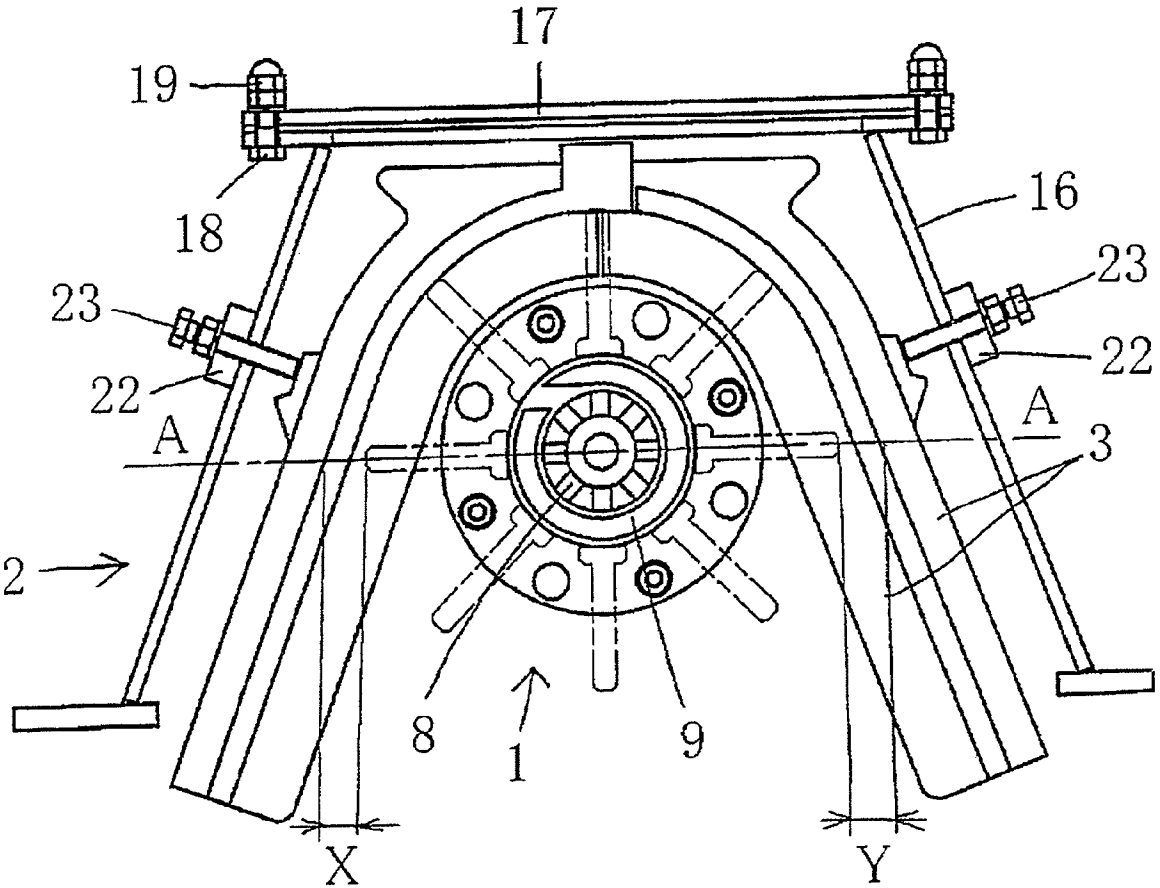
FIG. 2 is a front view with a partial sectional view of the embodiment of FIG. 1.

Below a machine for centrifugally shooting abrasives as an embodiment of the present invention is described with reference to FIGS. 1, 2, and 3. As shown in FIGS. 1 and 2, the machine for centrifugally shooting abrasives comprises an impeller 1 for centrifugally shooting the abrasives by the rotation of the impeller 1, a cover 2 for covering the impeller 1 to prevent the abrasives from being scattered, a side liner 3 for protecting, from the abrasives, the side wall of the cover 2 in the radial direction of the impeller 1, an electric motor 5 that is fixed, a guiding tube 6 attached to the cover 2 for guiding the abrasives to the inside of the impeller 1, a distributor 8 for distributing the abrasives that have been guided, and a control cage 9 for feeding the distributed abrasives to the impeller 1 in a controlled manner. The impeller 1 is mounted on a hub 4 that is fitted into the output shaft of the electric motor 5. The distributor 8 is detachably connected by a hexagonal socket head cap screw 7 to the center of a second side plate 11 of the impeller 1. The second side plate 11 is described below.

Figure 3:
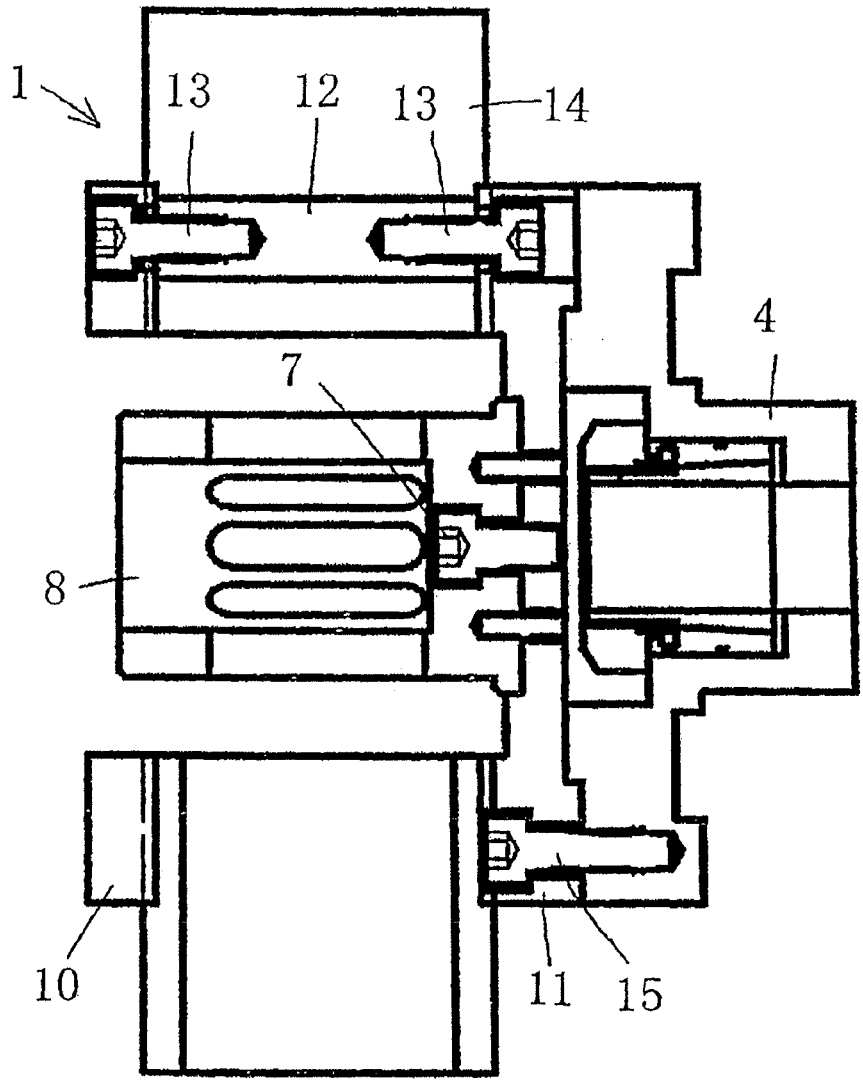
FIG. 3 is an enlarged and detailed view of the main part of the embodiment.

As shown in FIG. 3, in the impeller 1 a doughnut-shaped first side plate 10 that has an opening that allows the blade 14 to pass through it and a disc-shaped second side plate 11 are integrated with a plurality of stays 12•12 that are disposed between the first and second side plates 10•11 at constant intervals in the circumferential direction and a plurality of hexagonal socket head cap screws 13 that are screwed to respective stays from the outer sides of the first and second side plates 10•11. The first side plate 10 has in its center an opening whose size allows a blade 14 to pass through it. Further, between the first and second side plates 10•11 a plurality of the blades 14•14 are radially disposed at constant intervals. The lower halves of the blades 14•14 are fitted into the respective grooves (not shown) of the inner faces of the first and second side plates 10•11.

As shown in FIG. 3, in the impeller 1 the second side plate 11 is secured to the hub 4 by a hexagonal socket head cap screw 15, which is screwed from the inner side of the second side plate 11. The diameter of the impeller 1 is limited to be 200 mm at maximum. If the diameter of the impeller 1 were larger than 200 mm, it would be too heavy to handle by one hand. Thus the diameter is limited to 200 mm at maximum, so as to enable the impeller to be easily replaced. Further, if the impeller were too large, a driving source would become large, as would the machine for centrifugally shooting abrasives as well. Thus, for handling the impeller, it is better to have a smaller diameter. The cost of the raw materials would, of course, increase as the size increases.

However, when the diameter of the impeller becomes smaller, the speed at which it rotates must be faster to maintain the speed at which the abrasives are shot. A high speed of rotation of the impeller would cause vibrations or noise. To control this type of problem, an additional mechanism may be needed. Thus the machine may become complicated, which is a disadvantage. Thus, a proper diameter and a proper speed of rotation of the impeller must be selected to maintain a good handling of the impeller 1 and the proper amount of the shot abrasives. Normally, the speed at which the abrasives that are made of steel are shot is 61 to 81 m/s for sand-stripping as a following process for a cast or for descaling or for deflashing for a good produced by forging or plate working. Particularly, it is normal to have the speed of the shooting be around 73 m/s.

To optimize these parameters in the present invention, the diameter of the impeller 1 is set at 100 mm at minimum, preferably 120 mm or more, or more preferably 160 mm or more. Thus the diameter of the impeller 1 of the present invention is 100 mm at minimum and 200 mm at maximum, preferably between 120 mm and 200 mm, or more preferably between 160 mm and 200 mm. In these conditions, the speed of the rotation of the impeller is from 5,000 rpm to 10,000 rpm, preferably from 5,800 rpm to 10,000 rpm, or more preferably from 5,800 rpm to 7,200 rpm. The evaluations for the handling, the amount of the shot abrasives, and the speed of the rotation of the impeller with the variations of the diameters of the impellers, are summarized in Table 1.

TABLE 1

| | Diameter of Impeller (mm) | | | | | | | |
|---|---|---|---|---|---|---|---|---|
| | 80 | 100 | 120 | 140 | 160 | 180 | 200 | 210 |
| Handling | Good | Good | Good | Good | Good | Good | Good | Bad |
| Amount of Shot Abrasives | Low | Slightly Low | Sufficient | Sufficient | Sufficient | Sufficient | Sufficient | Sufficient |
| Speed of Rotation (rpm) | 12,000 | 9,800 | 9,700 | 8,300 | 7,200 | 6,500 | 5,800 | 5,500 |

As shown in FIG. 2, in the cover 2 a cover body 16 has a trapezoidal shape in the cross section where the upper and lower ends are open. A lid member 17 is detachably attached to the upper end by a plurality of bolts 18 and nuts 19 to shut the opening at the upper end. The size of the opening at the upper end of the cover body 16 allows the impeller 1 to pass through it.

As shown in FIG. 2, the side liner 3 is generally U-shaped, with the longer side facing downward. Its upper end is shaped as an arch. The upper part of the side liner is divisible at its center into two parts. The cross section of the side liner is U-shaped. The side liner 3 is fixed to the inner surfaces of the front and rear walls of the cover 2. It is sandwiched between two auxiliary liners 20•21 by their upper and side ends (see FIG. 1). The auxiliary liners 20•21 have trapezoidal shapes, with their upper ends being shaped as arches.

As shown in FIG. 2, respective members 22•22 for receiving bolts, which members are shaped as rectangles, are detachably attached to both outer sides of the side walls of the cover 2 by bolts (not shown). Two bolts 23•23 are screwed through respective members 22•22 for receiving respective bolts. They extend through the side walls to press the side liner 3.

In the machine for centrifugally shooting abrasives configured as discussed above, the bolts 18•18 are taken out by loosening the respective nuts 19•19. Then the lid member 17 is removed from the upper end of the cover body 16 to open the opening at the upper end. The members 22•22 for receiving bolts are removed from the cover 2 and the two bolts 23•23 are taken out. Then the side liner 3 is taken out through the opening at the upper end of the cover body 16. Thus the side liner 3 can be removed from the assembled machine as shown in FIG. 2. Further, by reversing the operations, the side liner 3 can be installed.

By taking out the plurality of hexagonal socket head cap screws 15•15 after removing the guiding tube 6 and the control cage 9 and taking out the side liner 3 as discussed above, the impeller 1 that has been assembled as shown in FIG. 3 can be detached from the hub 4 to be taken out through the opening at the upper end of the cover body 16. Further, by reversing the operations, the impeller 1 can be mounted on the hub 4 as shown in FIG. 3.

In the impeller 1 that is taken out of the cover body 16, the distributor 8 is removed from the second side plate 11 by loosening the hexagonal socket head cap screw 7. Then by moving the blades 14 toward the center of the impeller 1, they can be removed. Further, by reversing the operations, the impeller 1 can be assembled and the distributor 8 can be attached to the second side plate 11.

By removing the guiding tube 6, the control cage 9, and the distributor 8 and by moving the blades 14 toward the center of the first and second side plates 10•11, the blades 14 can be removed from the first and second side plates 10•11 while the impeller 1 remains mounted on the hub 4.

Incidentally, if the size of the machine for centrifugally shooting abrasives were to decrease in proportion to the diameter of the impeller, it would become difficult to insert one's hand or a tool inside the cover 2. Thus removing and attaching the impeller would become difficult. Thus for smoothly removing or attaching the impeller, the total clearance (X+Y in FIG. 2) between the side plates and the impeller at the section on the center where the impeller rotates (section A-A in FIG. 2) is from 10 mm to 40 mm, or preferably around 30 mm.

The invention claimed is:

1. A machine for centrifugally shooting abrasives that shoots the abrasives by rotation of an impeller, the impeller comprising a pair of side plates that face each other at a predetermined distance, and a plurality of blades disposed between the side plates in a radial direction of the side plates, the impeller being mounted on a hub that is fitted onto an output shaft of an electric motor, the impeller being covered by a cover body;

wherein a side liner that is U-shaped, with a longer side facing downward, is detachably attached to an inner side of the cover body, an upper part of the side liner being divisible into two parts, the side liner protecting a side wall of the cover body from the abrasives that are shot from the impeller, the side liner having a U-shaped cross section;

wherein the impeller is fixed to the hub by screwing a first bolt on the hub from an inner side of one of the side plates;

wherein the pair of the side plates are integrated by a plurality of stays and a plurality of secondary bolts being screwed through the stays, the stays being disposed at constant intervals in a circumferential direction between the side plates, the secondary bolts being screwed through the stays from outer sides of the side plates;

wherein the cover body has an opening at an upper end of the cover body, the opening having a size to allow the impeller to pass through the opening;

wherein a outer diameter of the impeller is limited to be from 160 mm to 200 mm; and wherein a speed of rotation of the impeller is from 5,800 rpm to 7,200 rpm.

2. The machine for centrifugally shooting abrasives of claim 1, wherein a total clearance between the side plates and the impeller at a section on a center where the impeller rotates is from 10 mm to 40 mm.

* * * * *